US010594048B2

(12) United States Patent
Bluemmel et al.

(10) Patent No.: US 10,594,048 B2
(45) Date of Patent: Mar. 17, 2020

(54) CRIMP FOR CONNECTING WIRES

(71) Applicants: TE Connectivity India Private Limited, Bangalore (IN); TE Connectivity Germany GmbH, Bensheim (DE)

(72) Inventors: Uwe Bluemmel, Hemsbach (DE); M. Saravanakumar, Theni (IN)

(73) Assignees: TE Connectivity India Private Limited, Bangalore (IN); TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/244,680

(22) Filed: Jan. 10, 2019

(65) Prior Publication Data

US 2019/0221949 A1 Jul. 18, 2019

(30) Foreign Application Priority Data

Jan. 12, 2018 (IN) ..... 201841001391

(51) Int. Cl.
*H01R 4/18* (2006.01)
*H01R 4/2495* (2018.01)
*H01R 43/058* (2006.01)

(52) U.S. Cl.
CPC ..... *H01R 4/184* (2013.01); *H01R 4/188* (2013.01); *H01R 4/2495* (2013.01); *H01R 43/058* (2013.01)

(58) Field of Classification Search
CPC .... H01R 4/188; H01R 4/2495; H01R 43/058; H01R 4/184; H01R 4/203
See application file for complete search history.

(56) References Cited

U.S. PATENT DOCUMENTS 3,670,298 A * 6/1972 Klumpp, Jr. ..... H01R 4/184 439/877
4,253,234 A * 3/1981 Niles ..... H01R 43/16 29/876
4,466,689 A * 8/1984 Davis ..... H01R 43/16 206/717
4,596,440 A * 6/1986 Quam ..... H01R 13/17 439/827
5,675,891 A * 10/1997 Childs ..... B23K 1/002 29/879
5,879,205 A * 3/1999 Egenolf ..... H01R 13/11 29/882
5,901,439 A 5/1999 Endo et al.
5,975,965 A * 11/1999 Jordan ..... H01R 9/0518 439/877
8,251,759 B2 * 8/2012 Matsunaga ..... H01R 4/185 439/877

(Continued)

FOREIGN PATENT DOCUMENTS

DE 10 2006 045 567 4/2008

OTHER PUBLICATIONS

Abstract of DE 10 2006 045 567, dated Apr. 24, 2008, 1 page.

*Primary Examiner* — Briggitte R. Hammond
(74) *Attorney, Agent, or Firm* — Barley Snyder

(57) ABSTRACT

A crimp segment comprises a crimp barrel having a base and a pair of opposing side walls extending from the base. Each of the side walls is adapted to bend around a plurality of wires disposed in the crimp barrel and a pair of ends of the side walls engage with one another along a staggered seam.

15 Claims, 3 Drawing Sheets

(56) References Cited

U.S. PATENT DOCUMENTS

| | | | | |
|---|---|---|---|---|
| 9,028,284 | B2 * | 5/2015 | Lengert | H01R 4/184<br>439/877 |
| 2006/0057904 | A1 * | 3/2006 | Sakaguchi | H01R 4/185<br>439/877 |
| 2006/0068653 | A1 * | 3/2006 | Sakaguchi | H01R 4/185<br>439/877 |
| 2013/0023155 | A1 * | 1/2013 | Ii | H01R 13/6593<br>439/607.27 |
| 2015/0255886 | A1 * | 9/2015 | Schmidt | H01R 4/183<br>439/877 |

* cited by examiner

CRIMP FOR CONNECTING WIRES

CROSS-REFERENCE TO RELATED APPLICATIONS

This application claims the benefit of the filing date under 35 U.S.C. § 119(a)-(d) of Indian Patent Application No. 201841001391, filed on Jan. 12, 2018.

FIELD OF THE INVENTION

The present invention relates to an electromechanical connector and, more particularly, to a crimp for connecting wires.

BACKGROUND

In electronics and electrical engineering, there are known a large number of electromechanical connections, which serve to transmit electrical currents, electrical voltages and/or electrical signals with the greatest possible range of currents, voltages, frequencies and/or data rates. Such connections must temporarily or permanently ensure correct transmission of mechanical contact, electrical power electrical signals and/or data under thermally loaded, dirty, damp and/or chemically aggressive conditions. Therefore, a large number of specially constructed electromechanical contacts, in particular crimp contacts are known.

A crimp connection is a solderless connection. The shape of the crimp and amount of pressure applied must be correct in order to obtain desired performance and durability of the connection. Improper crimps may generate heat due to poor electrical connection and may result in the rework of the product, increased scrap, and in extreme cases catastrophic failure.

Electrical terminals are often used to terminate the ends of wires. Such electrical terminals typically include an electrical contact and a crimp barrel. In some terminals, the crimp barrel includes an open area that receives an end of the wire therein. The crimp barrel is crimped around the end of the wire to establish an electrical connection between electrical conductors in the wire and the terminal as well as to mechanically hold the electrical terminal on the wire end. When crimped over the wire end, the crimp barrel establishes an electrical and mechanical connection between the conductors of the wire and the electrical contact. In addition to a permanent electrical connection, a permanent mechanical connection must also be produced between the cable and a conductor crimp region of the crimp contact. For an electromechanical connection, the crimp contact has the conductor crimp region and in most cases an insulation crimp region for the cable. Miniaturization and cost savings are forcing manufacturers towards smaller and thinner contacts.

Crimp connections known in the art serve to establish an electrical contact as well as to provide a mechanically resilient connection between a crimping base and at least one electrical conductor, which can consist of one or more individual wires. The crimp barrel usually consists of a metal plate, which is bent to have a U- or V-shaped cross-section or has rectangular cross-section with a flat base. The underside of the U- or V-shape is referred to as a crimp base. The upwardly pointing legs of the U- or V-shape are generally known as crimp flanks.

The crimp connection is produced by a crimping die, which consists of an anvil and a crimping stamp. For crimping, the crimping base is positioned centrally on the anvil, and the electrical conductor is placed between crimping legs on the crimping barrel. Subsequently, the crimping stamp descends onto the anvil and bends the crimp flanks around the electrical conductor in order to compress it tightly and to fix it in a force-locking manner with the crimping barrel. In the transition area from the crimp base to the crimp side walls, the so-called crimping roots, as well as laterally at the crimp side walls, zones of high bending stresses are formed in the crimp barrel. The force connection between the crimp barrel and the electrical conductor can be improved by providing additional form-fitting elements for example, recesses or depressions on the inner side of the crimp barrel facing the conductor for the creation of locking elements, wherein displaced conductor material can penetrate into the recesses during compression. The pressed zones of a crimping connection may have better electrical properties and the less heavily pressed areas have a higher mechanical stability. The crimping barrel and the electrical conductor can be locally reinforced by steps or projections in the crimping die.

U.S. Pat. No. 5,901,439 discloses how the compression of a crimp can be locally increased by feeding an additional punch through an opening in the working surface of the anvil when the crimping die is closed.

If the crimp connection is subjected to mechanical stress, the crimping flanks may spring up along the crimping roots and other zones of high bending stresses. There is the risk that the crimping base opens along the longitudinal seam at the ends of the crimp side walls. Depending on the type of stress, the ends of the crimp side walls can also move axially relative to each other. A reduction in the crimping forces, however, can result in the individual wires of the electrical conductor moving relative to each other. When they are displaced in the longitudinal direction, the force of the crimped connection is reduced by the resultant free spaces. The free spaces offer the possibility of external material penetrating into the crimped connection. The crimping forces are then further weakened by corrosion of the electrical conductor and the crimping barrel caused by the external agents.

In the event of a loss of crimping force, the desired mechanical stability of the crimping connection can no longer be maintained. It was found that in case of movements on the connected line or the electrical conductor, a movement of the individual wires of the electrical conductor at the other end of the crimp connection can be observed. This indicates that both the individual wires of the electrical conductor, as well as the electrical conductor and the crimp barrel are no longer fixed in a sufficiently secure manner. In the individual case, therefore, increased electrical transition resistances between the crimp barrel and the electrical conductor can occur.

To achieve mechanical and electrical robustness of the crimp connection, the crimp barrel must have sufficient stock thickness of the sheet metal related to the wire size. Especially for large wire sizes, this minimum barrel stock thickness creates disadvantages as it presents difficulty in cutting, bending, or forming in the stamping process to manufacture an electrical element from sheet metal, and requires high force for crimping and requires high material costs.

On the other hand, when using too thin stock, the crimp starts to fail at the seam of the roll-in for mechanical and electrical performance. German Patent Application DE 102006045567 describes a staggered seam on an F-Crimp formed by a crimp tool with consecutive offset in the roll-in geometry. In this crimp connection, the crimp with a thinner sheet metal presents the problems mentioned above.

The measures known in the art for providing form-locking elements or a reinforced crimping connection elements cannot prevent the crimp barrel from being deflected and permit a relative movement of the individual wires of the electrical conductor and the resulting losses of crimping forces.

SUMMARY

A crimp segment comprises a crimp barrel having a base and a pair of opposing side walls extending from the base. Each of the side walls is adapted to bend around a plurality of wires disposed in the crimp barrel and a pair of ends of the side walls engage with one another along a staggered seam.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
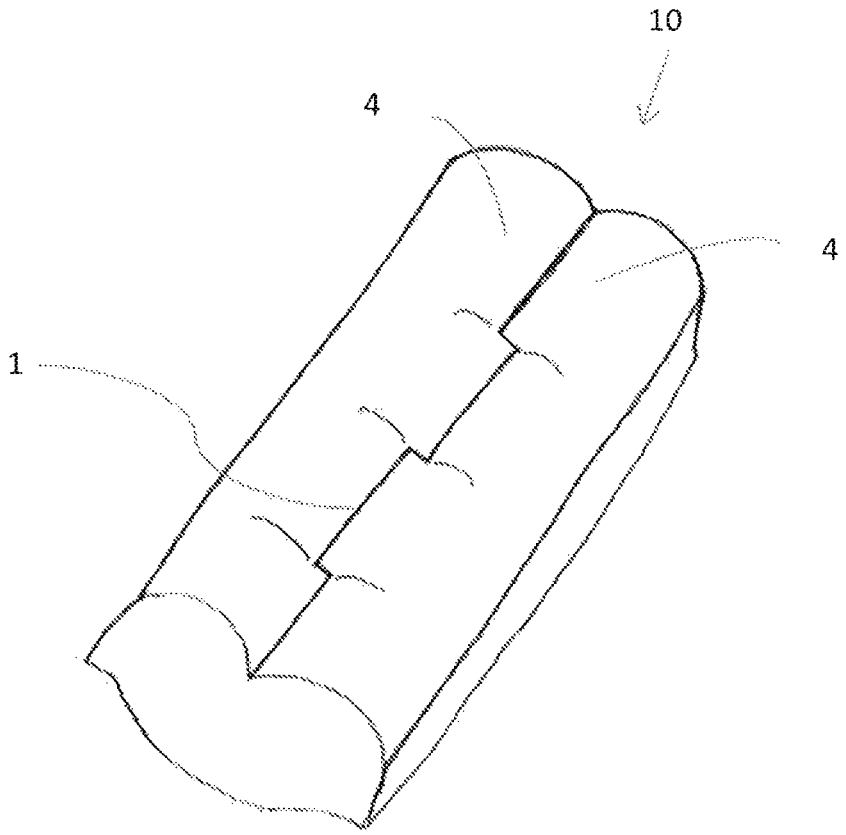
FIG. 1 is a perspective view of a crimp connection according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A crimp connection 10 according to an embodiment is shown in a crimped state in FIG. 1. A pair of side walls 4 of the crimp connection 10 are in the crimped state forming a "square meandering" or a "zig-zag" staggered seam 1. In FIG. 1, the crimp connection 10 is such that the staggered seam 1 of the crimp connection 10 increases the robustness with the thinner stock material.

The side walls 4 of the crimp connection 10 engage to form the staggered seam 1 in a longitudinal direction of the crimp connection 10. Engagement elements on ends of the side walls 4 effect a form-fit between the ends of the side walls 4 along the longitudinal seam 1. The ends of the crimp side walls 4 are rigidly connected to one another by the form-fit connection. The rigid connection of the ends of the crimp side walls 4 increases the overall stability of the crimp connection 10 and thus prevents a loss of crimp forces due to the forces and moments applied to the crimp connection 10. The form-fit between the ends of the crimp side walls 4 also increases a resistance moment of the bent side walls 4 against bending. The ends of the side walls 4 can no longer be displaced in the longitudinal direction due to the engagement with one another at the staggered seam 1. Any loss of the crimping forces due to the relative movement of the crimping flanks of side walls 4 in the longitudinal direction can thus be prevented.

In an embodiment, the crimped connection 10 shown in FIG. 1 can be designed in such a way that the staggered seam 1 in the longitudinal direction has a lateral offset at least in sections. The offset allows the material of the opposing sections of the crimping flanks or side walls 4 to flow around one another during the crimping process and to provide the form fit.

Figure 2:
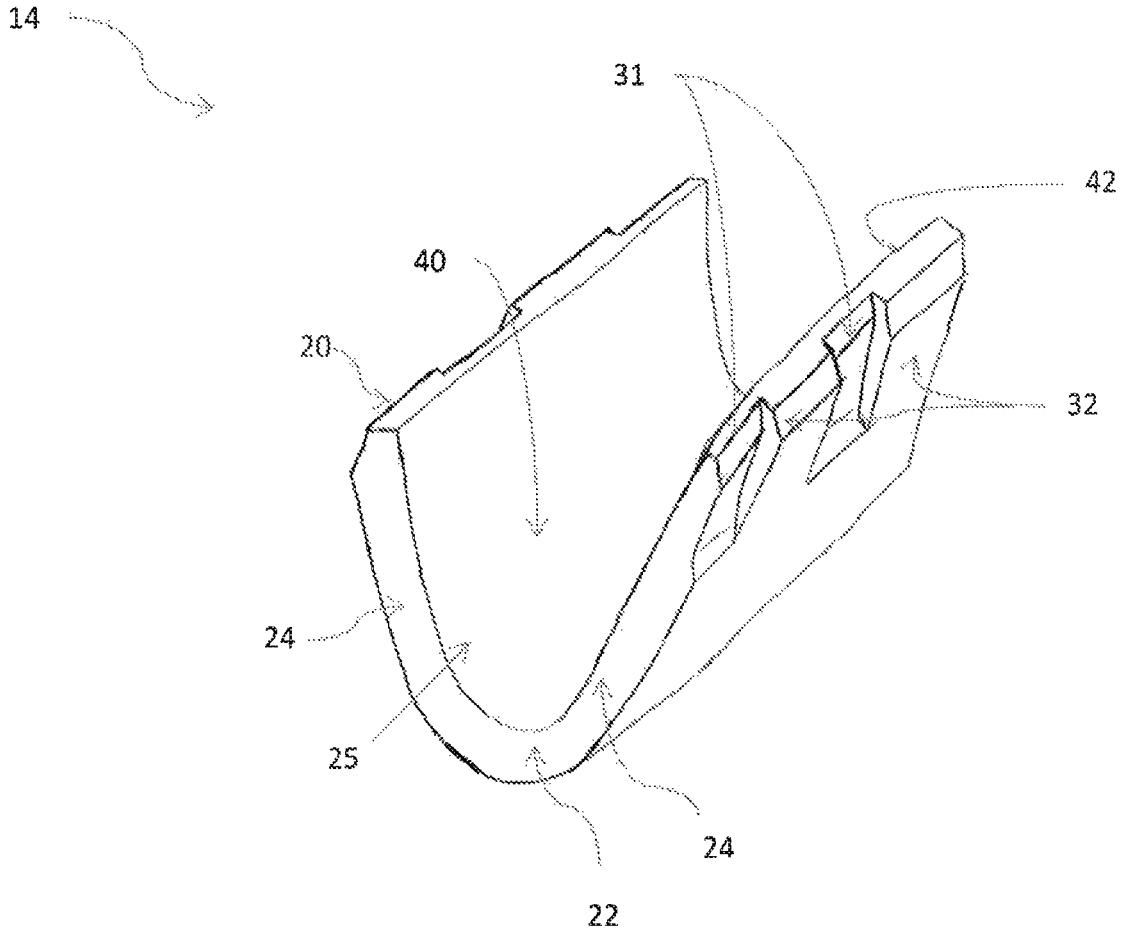
FIG. 2 is a perspective view of a crimp segment according to an embodiment in an open state.

A crimp segment 14 is shown in FIG. 2 that is used to produce the crimp connection 10 shown in FIG. 1. The crimp segment 14 includes a crimp barrel 20. In the shown embodiment, the crimp barrel 20 is an F-crimp wire barrel. The crimp barrel 20 includes a base 22 and opposing side walls 24 also referred to as crimp flanks that extend from the base 22. The base 22 and the side walls 24 define an opening 25 of the crimp barrel 20 that is configured to receive an end of a wire (not shown) that may include one or more electrical conductors. The crimp segment 14 may also be a part of a crimp that additionally comprises contact elements, a strain relief or the like.

As shown in FIG. 2, the base 22 and the side walls 24 extend along and define the entirety of a length of the crimp barrel 20 in a longitudinal direction of the crimp barrel 20. The base 22 includes an interior surface 40, and each of the side walls 24 includes an interior surface 42. The interior surfaces 40 and 42 define boundaries of the opening 25 of the crimp barrel 20.

The crimp barrel 20 is configured to be crimped around the end of the wire to mechanically and electrically connect the wire to a terminal. In an embodiment, the wire is an electrical wire and includes an electrical insulation layer extending around the electrical conductors along at least a portion of the length of the electrical conductors. The ends of the crimp flanks 24 are clamped along the staggered seam 1 as shown in the embodiment of FIG. 1. Crimping force losses due to an opening of the staggered seam 1 are prevented by an engagement of the crimp flanks 24 with one another as described with respect to FIG. 1 above.

The crimp segment 14 may be fabricated from any materials, such as, but not limited to, copper, a copper alloy, copper clad steel, aluminum, nickel, gold, silver, a metal alloy, and/or the like. One or more portions or all of the crimp segment 14 may be fabricated from a base metal and/or metal alloy that is coated, such as by plating, with another material, such as another metal and/or metal alloy. In an embodiment, one or more portions or the entire crimp segment 14 may be fabricated from a copper base that is plated with nickel. The electrical conductors may be fabricated from any materials, such as, but not limited to, aluminum, an aluminum alloy, copper, a copper alloy, copper clad steel, nickel, gold, silver, a metal alloy, and/or the like.

As shown in the non-crimped state of FIG. 2, the ends of the crimp side walls 24 have been embossed to form embossed regions 32 and deepened to form deepened regions 31 to provide interlock surfaces for additional engagement along the staggered seam 1. When the two side walls 24 of the crimp barrel 20 are engaged, the embossed area 32 of one of the crimp flanks 24 engages with the deepened area 31 of the opposing crimp flank 24. In an embodiment, the deepened area 31 has a depth of ⅓ to ½ of a thickness of the side wall 24.

The staggered seam 1 is reinforced by having embossed areas 32 and deepened areas 31 on the outer surface of the crimp flanks 24 which are extending outwards from the crimp barrel 20. The embossed and deepened areas 31, 32 of the crimp segment 14, in various embodiments, could be realized by various methods for example by milling, corrugation, pressing, or deformation of the material. The interlocking resists axial distortion of the flanks 24 and the embossed areas 32 and deepened areas 31 provide additional reinforcement by axial elongation of the crimp segment 14. The staggered seam 1 has a plurality of interlock zones along which the side walls 24 are interlocked. In an embodiment, the embossed areas 31 and the deepened areas 32 are disposed on both an interior surface 40, 42 and an outer surface of each of the side walls 24 and extend up to the base 22 of the crimp barrel 20.

Figure 3:
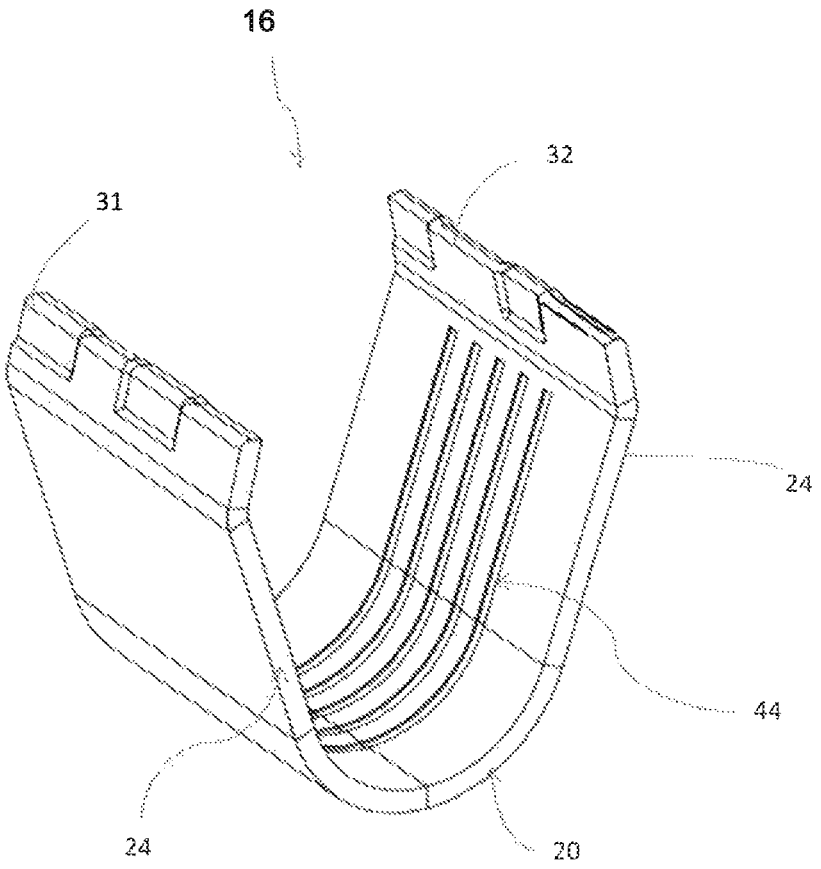
FIG. 3 is a perspective view of a crimp segment according to another embodiment in an open state.

In another embodiment, a crimp segment 16 shown in FIG. 3 is used to produce the crimp connection 10 shown in FIG. 1. The crimp segment 16 has the crimp barrel 20 and deepened and embossed areas 31, 32 on both sides of the crimp flanks 24 to increase the interlock surfaces and enhance interlocking along the staggered seam 1.

As shown in FIG. 3, inner surfaces of the side walls 24 of the crimp barrel 20 include at least one fixing zone 44. In an embodiment, the fixing zone 44 is sharp-edged grooves, such as serrations, which may ensure a stronger grip of the conductor. The crimp barrel 20 may include aluminum, so that crimping may ensure partial cold welding and consequently establish a good electrical connection. In various embodiments, the fixing zone 44 is a 3D structure zone having at least one groove and/or rib, a grooved structure, a ripple structure, a corrugated structure or a serration, that is to say, a "tooth-like arrangement" having wide teeth which extend substantially in the transverse direction. The fixing zone 44 is constructed in a similar manner on the inner surface of both side walls 24 of the crimp barrel 20 and as mirror images of each other around the longitudinal axis of the crimp barrel 20.

In an embodiment in which the fixing zone 44 on the interior surfaces 40, 42 of the side walls 24 is one or more serrations 44, the serrations 44 penetrate an oxide and/or other surface material layer, such as residual wire extrusion enhancement materials, that has built up on the electrical conductors. The interior surfaces 40 and 42 may each be referred to herein as a "metallic surface" of the crimp barrel 20.

In order to contact an electrically conductive wire, the crimp including the crimp segment 14, 16 is for example attached to conductors of the wire. An electrical insulation layer may be removed from at least a portion of ends of the electrical conductors for exposing the conductor ends. In some embodiments, an electrical terminal includes an electrical contact and the crimp barrel 20, and the crimp barrel 20 is configured to be crimped around the end of an electrical wire to mechanically and electrically connect the electrical wire to the terminal. In an embodiment, the terminal is configured to electrically connect the electrical wire to another electrical wire. In other words, the terminal including the crimp barrel 20 and the crimp segment 14, 16 may be used to splice the electrical wire to another wire.

The electrical and mechanical connections of the crimp segment 14, 16 are created using a crimping device. The crimping device crimps the crimping segment 14, 16 to the wire. In an embodiment, the electrical wire has electrical conductors that are received in a crimp barrel 20. An end segment of the wire has exposed conductors that are loaded into the crimp barrel 20. During a crimping operation, the barrel 20 is crimped around the conductors forming a mechanical and electrical connection between the crimp segment 14, 16 and the electrical wire.

The crimping operation crimps the crimp segment 14, 16 to mechanically hold the conductors and to provide an engagement between the conductors and the crimp segment 10, 14. Forming of the terminal may include bending arms or tabs around the wire conductors as in an open terminal, such as an "F" type crimp, or compressing a closed barrel around the wire conductors as in a closed terminal, such as an "O" type crimp. As the terminal is formed around the wires during the crimping action, the metal of the terminal and/or of the conductors within the terminal may be extruded. A secure mechanical connection and a good quality electrical connection is formed between the terminal and the electrical wire.

The length of the side walls 24 is such that when the side walls 24 are engaged to form the staggered seam 1, the ends of the side walls 24 do not hit the inner surface of the crimp connection 10.

The crimping device includes an anvil and a crimp tooling member. The anvil has a top surface that receives the crimp segment 14, 16 thereon. The electrical conductors of the wire are received in the crimp barrel 20 on the anvil. The crimp tooling member includes a forming profile that is selectively shaped to form or crimp the barrel 20 around the conductors when the forming profile engages the crimp segment 14, 16. The forming profile defines part of a crimp zone in which the crimp segment 14, 16 and wire are received during the crimping operation. The top surface of the anvil also defines a part of the crimp zone, as the crimp segment 14, 16 is crimped to the wire between the crimp tooling member and the anvil.

The crimp tooling member is movable towards and away from the anvil along a crimp stroke. The crimp stroke has an upward component away from the anvil and a downward component towards the anvil. The crimp tooling member moves bi-directionally, towards and away from the anvil, along a crimp axis. The crimp tooling member forms the crimp segment 14, 16 around the electrical conductors during the downward component of the crimp stroke as the crimp tooling member moves towards the anvil. Although not shown, the crimp tooling member may be coupled to a mechanical actuator that propels the movement of the crimp tooling member along the crimp stroke. For example, the crimp tooling member may be coupled to a movable ram of an applicator or lead-maker machine. In addition, the applicator or the lead-maker machine may also include or be coupled to the anvil and the base support of the crimping device.

During a crimping operation, the crimp segment 14, 16 is loaded onto the top surface of the anvil. The wire is moved in a loading direction towards the crimp zone such that the electrical conductors are received in the crimp barrel 20 between the two side walls 24. As the crimp tooling member moves toward the anvil, the forming profile descends over the crimp barrel 20 and engages the side walls 24 to bend or form the walls 24 around the electrical conductors. More specifically, side tabs and the top-forming surface of the forming profile gradually bend the side walls 24 over a top of the electrical conductors as the crimp tooling member moves downward. The left arch of the forming profile is configured to engage and bend a left side wall 24 of the crimp barrel 20, while the right arch is configured to engage and bend a right side wall 24 of the crimp barrel 20. At a bottom dead position of the crimp tooling member, which is the lowest position (or most proximate position to the base support) of the crimp tooling member during the crimp stroke, part of the forming profile may extend beyond the top surface of the anvil.

The crimp segment 14, 16 is compressed between the forming profile and the anvil, which causes the side walls 24 of the crimp barrel 20 to mechanically engage and electrically connect to the electrical conductors of the wire. High compressive forces cause metal-to-metal bonds between the side walls 24 and the conductors. During the crimping operation as described herein the staggered seam 1 is formed when the side walls 24 of the crimp barrel 20 engage with each other.

There are two mechanisms for establishing and maintaining permanent contact in the crimp connection 10, cold welding and the generation of an appropriate residual force distribution. Both mechanisms create a permanent connection and are independent of each other. During crimping, two metal surfaces are brought under an applied force to sliding or wiping actions thus welding the metals in cold welding. Under an appropriate residual force distribution the contact interface will experience a positive force. During crimping, residual forces are developed between the conductor and the crimp barrel 20 as the crimp tooling is removed which is an indicative of different elastic recovery. When the electrical conductor tends to the spring back more than the crimp barrel 20, the barrel 20 exerts a compressive force on the conductor which maintains the integrity of the contact interface. The electrical and the mechanical performance of the crimped connection 10 results from a controlled deformation of conductors and crimp barrel 20 which produce micro cold welded junctions between the conductors and between conductors and the crimp barrel 20. These junctions are maintained by an appropriate residual stress distribution within the crimped connection 10 which leads to residual forces which in turn maintain the stability of the junctions.

During the application of an external force (for example a tensile force) on the crimp connection 10, the interlocking between the crimps flanks 24 could be misaligned, thus resulting in a poor crimp connection. Hence crimp connections 10 with embossed areas 32 and deepened areas 31 that are tapering in an inward direction toward the staggered seam 1 are provided in embodiments of the crimp connection 10. Such tapered embossed areas 32 and deepened areas 31 could be provided both inside or outside of the crimp flanks 24, thereby ensuring that interlocking is maintained even when a tensile force is applied at an angle not equal to the normal vector in the lateral direction of the outer surface of the crimp flank 24.

What is claimed is:

1. A crimp segment, comprising:

a crimp barrel having a base and a pair of opposing side walls extending from the base, each of the side walls is adapted to bend around a plurality of wires disposed in the crimp barrel and a pair of ends of the side walls engage with one another along a staggered seam, the crimp barrel has an embossed area and a deepened area on both an interior surface and an outer surface of each of the side walls.

2. The crimp segment of claim 1, wherein the embossed area and the deepened area are disposed on the ends of the side walls.

3. The crimp segment of claim 2, wherein the embossed area of a first side wall of the pair of side walls engages with the deepened area of a second side wall of the pair of side walls.

4. The crimp segment of claim 3, wherein the deepened areas of the side walls each have an interlock surface.

5. The crimp segment of claim 1, wherein the staggered seam has a plurality of interlock zones in which the side walls are interlocked.

6. The crimp segment of claim 1, wherein the embossed areas and the deepened areas extend up to the base of the crimp barrel.

7. The crimp segment of claim 1, wherein the crimp barrel is an F-crimp wire barrel.

8. The crimp segment of claim 2, wherein a depth of the deepened area is ⅓ to ½ of a thickness of one of the side walls.

9. A method for producing a crimp connection to a plurality of wires, comprising:

bending a base of a crimp barrel around the wires, the crimp barrel having a pair of opposing side walls extending from the base and engaging with one another along a staggered seam, the crimp barrel has an embossed area and a deepened area on both an interior surface and an outer surface of each of the side walls.

10. The method of claim 9, wherein the embossed area and the deepened area are disposed on the ends of the side walls.

11. The method of claim 10, wherein the embossed area of a first side wall of the pair of side walls engages with the deepened area of a second side wall of the pair of side walls.

12. The method of claim 11, wherein the deepened areas of the side walls each have an interlock surface.

13. The method of claim 9, wherein the staggered seam has a plurality of interlock zones in which the side walls are interlocked.

14. The method of claim 9, wherein the crimp barrel is an F-crimp wire barrel.

15. The method of claim 10, wherein a depth of the deepened area is ⅓ to ½ of a thickness of one of the side walls.

* * * * *